US005114301A

United States Patent [19]

Ramun

[11] Patent Number: 5,114,301

[45] Date of Patent: May 19, 1992

[54] ROTATOR FOR BACKHOE EQUIPMENT

[75] Inventor: John Ramun, Youngstown, Ohio

[73] Assignee: Allied Gator, Inc., Youngstown, Ohio

[21] Appl. No.: 639,300

[22] Filed: Jan. 10, 1991

[51] Int. Cl.[5] ..... B66C 23/00

[52] U.S. Cl. ..... 414/742; 414/743; 414/740; 414/735

[58] Field of Search ..... 414/620, 715, 732, 735, 414/738, 739, 740, 743, 742

[56] References Cited

U.S. PATENT DOCUMENTS 2,725,996 12/1955 Britton ..... 414/735
3,143,233 8/1964 Evans et al. ..... 414/620
3,549,031 12/1970 Blood et al. ..... 414/738 X
3,700,132 10/1972 Waters ..... 414/743 X
3,786,948 1/1974 Golden ..... 414/743 X
3,920,137 11/1975 McCain .
4,017,114 4/1977 La Bounty .
4,451,194 5/1984 Keats et al. .
4,854,800 8/1989 Frick et al. ..... 414/786 X

*Primary Examiner*—Robert J. Spar
*Assistant Examiner*—William M. Hienz
*Attorney, Agent, or Firm*—Harpman & Harpman

[57] ABSTRACT

A rotator for use on backhoe boom to rotate attachments thereon relative to the boom. The rotator has a main support frame pivotally secured to the boom with a rotating extension mount onto which the attachment is secured. A rotary joint for hydraulic controls extends from the main support frame and a hydraulic drive motor and gear assembly engage and rotate the extension mount extending from the main support frame.

5 Claims, 4 Drawing Sheets

ROTATOR FOR BACKHOE EQUIPMENT

BACKGROUND OF THE INVENTION

1. Technical Field

This device relates to rotators for backhoe attachments such as power shears and the like that are positioned on the end of backhoe booms. Such rotators are used to move the attachment about a center axis defined by the rotator which is pivotally disposed on the boom for vertical movement.

2. Description of Prior Art

Prior Art devices of this type have been dedicated to one type of attachment on a rotary mount in a specific area of expertise, see for example U.S. Pat. Nos. 4,451,194, 4,017,114 and U.S. Pat. No. 3,920,137.

In U.S. Pat. No. 4,451,194 an integral heel tree length grapple can be seen for lifting and maneuvering elongated items in grapple jaws extending from an elongated arm both of which are pivotally secured to a frame on the end of a boom. The hydraulic motor drives a sproket gear attached to the elongated frame pivoting same in an arcuate path about a pivot point for a limited effective rotational movement.

U.S. Pat. No. 4,017,114 is directed to a multi-directional grapple that attaches to the end of a backhoe boom. The dedicated grapple assembly can be rotated about a central axis on a mounting plate by a hydraulic motor and gear assembly.

In U.S. Pat. No. 3,920,137 an excavating machine with clam shell bucket can be seen that uses multiple pivot points to achieve multi-directional positioning of the bucket in relation to the boom on which it is attached.

SUMMARY OF THE INVENTION

A univeral rotator mountable on a backhoe boom to which a variety of attachments can be secured. The rotator provides a suitable self-contained mounting platform with pre-positioned mounting and pivot points on a rotatable portion capable of 360° rotation of the attachment mounted thereon.

DESCRIPTION OF THE PREFERRED EMBODIMENT

Figure 3:
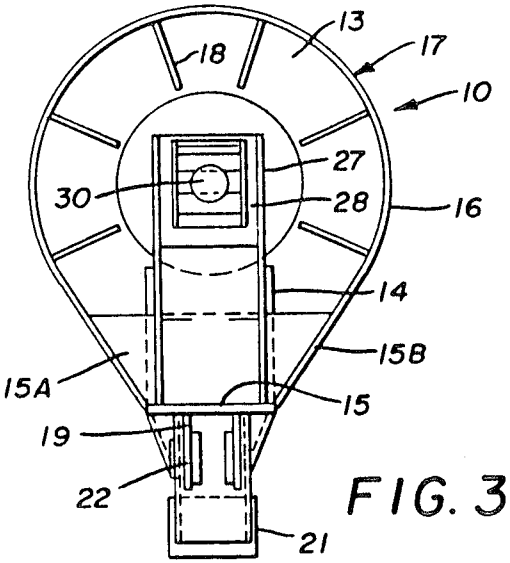
FIG. 3 is a partial end view on lines 3—3 of FIG 1.
Figure 2:
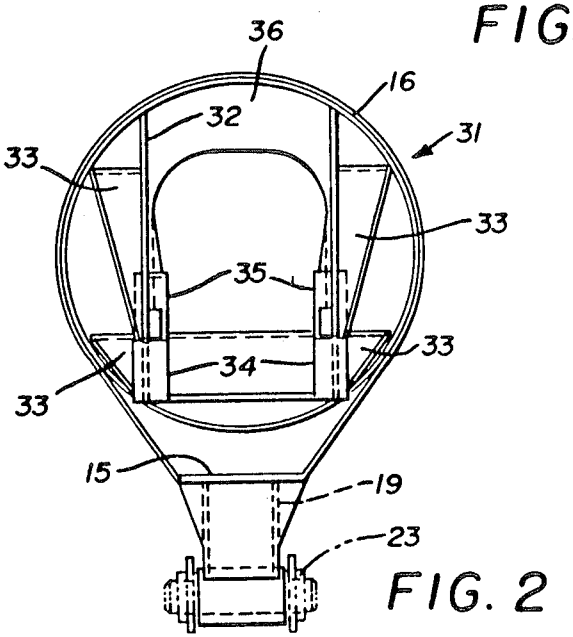
FIG. 2 is an end plan view of lines 2—2 of FIG. 1.
Figure 5:
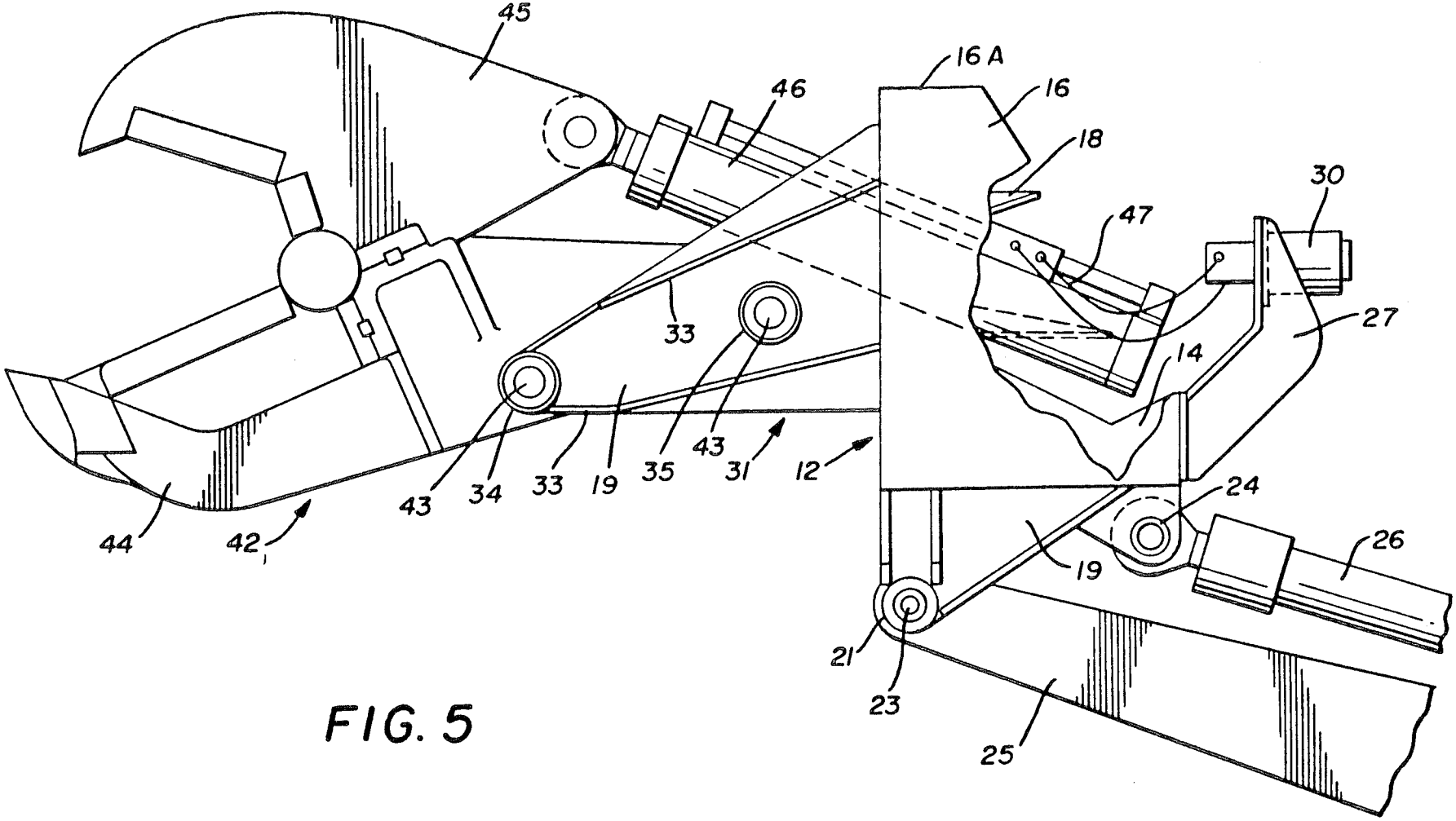
FIG. 5 is a side plan view with portions broken away of the device with a cutting shear attachment mounted thereon.

As seen in FIGS. 2, 3, and 5 of the drawings, a rotator device for a backhoe attachment can be seen comprising a fixed main frame 12 having a vertically disposed apertured disk 13 with a pair of parrallel space frame support elements 14 extending at right angles therefrom. The support elements 14 are secured to one another by joiner plates 15 and 15A, said joiner plate 15 is generally rectangular and extends between said support elements 14 and beyond said disk member 13. The joiner plate

15A is positioned over the respective free ends of said support elements 14 extending outwardly therefrom terminating at an angularly disposed perimeter edge at 15B. A continuous contoured annularly disposed wall 16 extends around said disk 13 to the intersections of the support elements 14 in the respective joiner plates 15 and 15A defining a structural support sleeve 17. The continuous contoured side wall 16 is tapered along its perimeter edge from a point defined by said intersection of said joiner plates and said frame support elements 14 to an oppositely disposed point of a reduced vertical height at 16A. A plurality of annularly spaced support gussets 18 are secured between said disk 13 and said side wall 16 reinforcing the same as will be well understood by those skilled in the art. Pairs of journaled attachment plates 12 and 20 extend from said joiner plate 15 on the main frame 12 and have pairs of spaced mounting bushings 21 and 22 positioned within for registration with a backhoe boom 25 and a backhoe's piston and cylinder assembly 26 via pivot pins 23 and 24 as shown in broken lines in FIG. 1 of the drawings.

An extension bracket assembly 27 extends from said joiner plate 15A supporting a spaced angularly offset mounting plate 28 positioned in spaced relation to said disk 13 hereinbefore described. A hydraulic rotary joint 30 is secured to said mounting plate 28 to provide the required hydraulic connection to the attachment as will be discussed in greater detail later.

Figure 1:
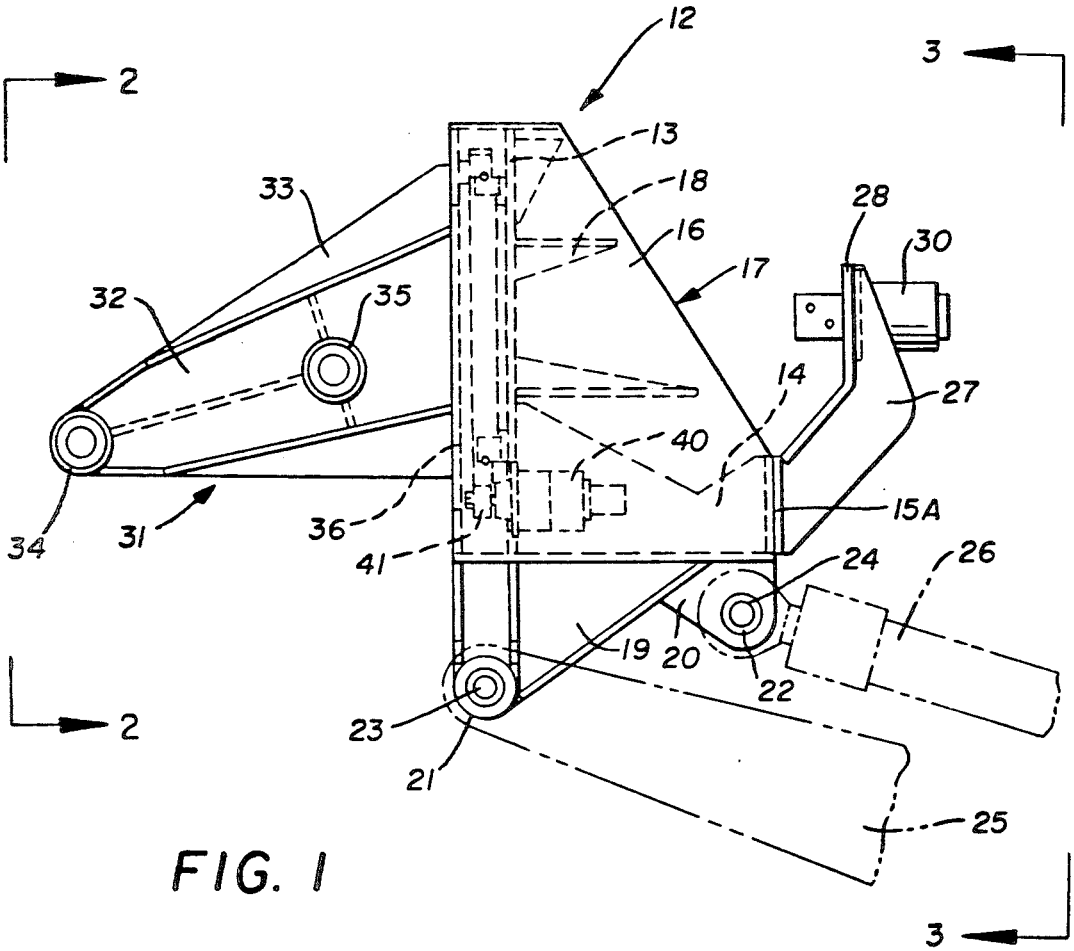
FIG. 1 is a side plan view of the rotator device on a backhoe boom.

Referring now to FIGS. 1 and 2 of the drawings, a rotatable attachment mounting assembly 31 can be seen including horizontally spaced parallel beams 32 each having angularly disposed reinforcing support webs 33 and a pair of longitudinally spaced reinforced bushings 34 and 35 respectively. A cross support plate 32A is secured to the bottom of said spaced parallel beams 32 interconnecting same.

Figure 6:
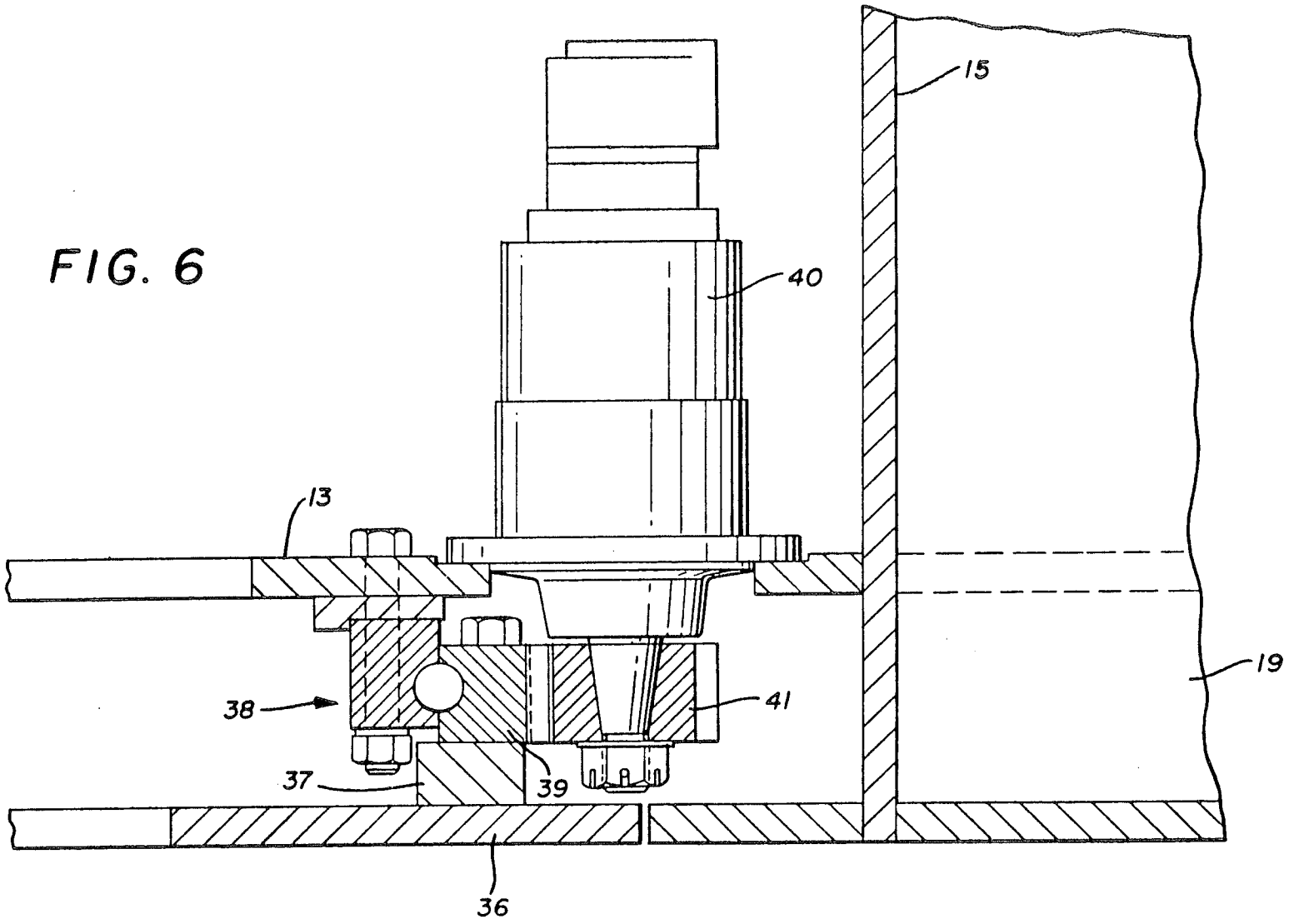
FIG. 6 is an enlarged cross-sectional view of a portion of the device showing a hydraulic motor and drive assembly.

The beams 32 extend from and are secured to a rotatable apertured support plate 36 having a bearing mounting ring 37 positioned thereon. An avon type bearing assembly 38 is secured to said mounting ring 37 and said disk 13 as will best be seen in FIG. 6 of the drawings effectively rotatably securing said rotatable attachment mounting assembly 31 within said fixed main frame 12 hereinbefore described.

The said bearing assembly 38 has a ring gear 39 formed thereon that is driven by a hydraulic motor 40 and drive gear 41 secured to and extending through said disk 13 that will provide effective rotation of said rotatable attachment mounting assembly 31 within said fixed main frame 12.

Figure 4:
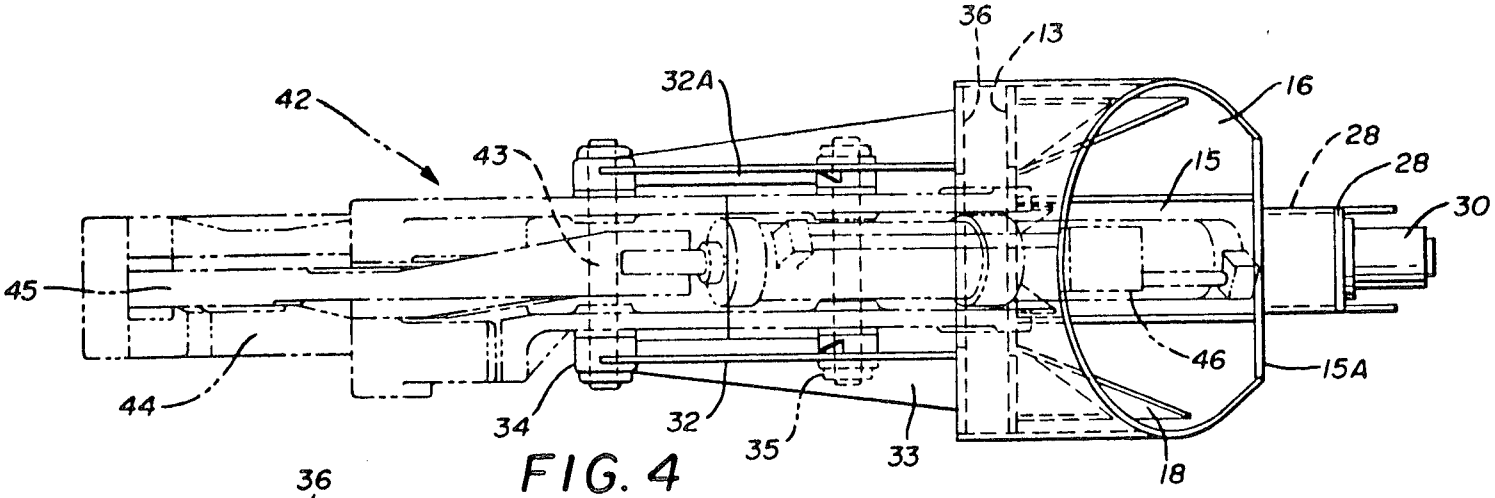
FIG. 4 is a top plan view of the device with a shear attachment shown in broken lines.

Referring now to FIGS. 4 and 5 of the drawings a shear attachment 42 can be seen mounted on said rotatable attachment mounting assembly 31. The shear attachment 42 is supported on mounting pins 43 extending through and between respective bushings 34 and 35 and is comprised of a fixed blade 44 and a movable blade 45 driven by its own hydraulic cylinder 46. The shear attachment 42 is illustrated and described in applicant's own U.S. Pat. No. 4,686,767 and is representative of a typical type of shear attachment utilized in this environment.

In operation, a portion of the shear attachment 42 and hydraulic cylinder 48 will extend through the respective apertured support plate 36 and apertured disk 13 on the main frame 12 allowing for rotation of the shear attachment 42 within. The hydraulic rotary joint 30 interconnects the shear's hydraulic cylinder 46 via supply lines 47 during its relative rotation within the main fixed frame as best seen in FIG. 5 of the drawings.

It will be apparent from the above description that a variety of different attachments for a backhoe can be removably mounted on said rotator device of the invention by simple modification of the respective points of attachment characterized in this preferred embodiment by the rotatable attachment mounting assembly 31. It will also be seen that full independent rotation of the shear attachment 42 can be achieved in relation to the main fixed frame 12 that is pivotally secure to the end of the backhoe boom 25 and associated hydraulic cylinder 26 imparting vertically aligned arcuate movement of the main fixed frame 12 typical of that normally available in a non-rotatable shear attachment 42 on a backhoe within the prior art.

The structural support sleeve 17 defined by the continuous contoured annular side wall 16 and the disk 13 takes advantage of the intrinsic structural strength and support of a cylindrical shape which is critical to the support requirement for attachments illustrated by the shear 42 which out of necessity must be relatively massive so as to withstand the forces imparted on such attachments during use.

Thus it will be seen that a new and novel rotator device for backhoes has been illustrated and described and it will be apparent to those skilled in the art that various changes and modifications may be made therein without departing from the spirit of the invention, therefore I claim:

1. A rotator device for attachments on a backhoe having a boom with controlled piston and cylinder assembly connected thereto comprising, a main frame pivotally secured to said boom, and a rotatable attachment mounting assembly within said main frame, said main frame having an apertured disk, a continuously contoured annular side wall extending in opposite directions to said disk and secured at right angles to said disk along an edge thereof so as to at least partially enclose said rotatable attachment mounting assembly, reinforcing elements interconnecting said disk with said side wall, a hydraulic rotary joint spaced in relation to said disk, means for interconnecting said disk, annular wall and said rotary joint, said rotatable attachment mounting assembly comprising spaced parallel beams extending from an apertured support plate, bushings within said beams, a bearing assembly interconnecting said apertured disk and said apertured support plate and maintaining them in spaced relation to one another, and means for driving said attachment mounting assembly relative to said main frame.

2. The rotator device of claim 1 wherein said means for interconnecting said disk, said annular side wall and said rotary joint comprises spaced parallel support elements extending from said disk, joiner plates, and an extension bracket assembly secured to one of said joiner plates, said extension bracket extending angularly and outwardly therefrom to said rotary joint.

3. The rotator device of claim 1 wherein said means for driving said rotatable attachment mounting assembly relative to said main frame comprises a motor and drive gear assembly on said main frame.

4. A rotator device for a shear attachment on a backhoe having a boom with a controlled piston and cylinder assembly connected whereto comprising, a main frame pivotally secured to the free end of said boom, a rotatable attachment mounting assembly within said main frame, said main frame having a vertically aligned apertured disk, a continuous annular side wall secured to said disk at right angles thereto and extending therefrom in oppositely disposed directions so as to at least partially enclose said rotatable attachment mounting assembly, a plurality of reinforcing elements interconnecting said disk with said side wall, spaced parallel support elements and interconnecting joiner plates extending from said disk, said rotatable attachment mounting assembly comprising spaced parallel beams extending from an apertured support plate rotatably secured in spaced parallel relation with said disk and within said main frame, means for removably securing the shear attachment to said beams, wherein said rotatable attachment mounting assembly is rotatably secured to said main frame by a bearing assembly, further comprising means for driving said rotatable attachment mounting assembly relative to said main frame.

5. The rotator device of claim 4 wherein said means for removably securing said shear attachment to said beams comprises pairs of spaced reinforced bushings within said beams.

* * * * *